US007789338B2

(12) United States Patent
Acciari

(10) Patent No.: US 7,789,338 B2
(45) Date of Patent: Sep. 7, 2010

(54) WINDING ROD FOR WINDING REELS OF WEBLIKE MATERIAL, AND MACHINE THAT USES SAID ROD

(75) Inventor: Giuseppe Acciari, Lucca (IT)

(73) Assignee: A. Celli Nonwovens S.p.A., Lucca (IT)

( * ) Notice: Subject to any disclaimer, the term of this patent is extended or adjusted under 35 U.S.C. 154(b) by 0 days.

(21) Appl. No.: 12/279,879

(22) Filed: Oct. 29, 2008

(65) Prior Publication Data

US 2009/0045281 A1 Feb. 19, 2009

(51) Int. Cl.
*B65H 19/28* (2006.01)

(52) U.S. Cl. ..... 242/532.1; 242/541.1; 242/542.3; 242/583

(58) Field of Classification Search ..... 242/532, 242/532.1, 532.3, 580.1, 583, 585, 541.1, 242/542.3
See application file for complete search history.

(56) References Cited

U.S. PATENT DOCUMENTS

| | | | | |
|---|---|---|---|---|
| 3,471,097 | A | 10/1969 | Phelps | |
| 4,143,828 | A | 3/1979 | Braun et al. | |
| 4,196,865 | A | 4/1980 | Patriksson | |
| 4,283,023 | A | 8/1981 | Braun et al. | |
| 4,285,480 | A * | 8/1981 | Parker | 242/332.7 |
| 5,197,687 | A | 3/1993 | Yamada et al. | |
| 5,251,835 | A | 10/1993 | Kyytsonen | |
| 5,393,008 | A | 2/1995 | Kyytsonen et al. | |
| 5,531,396 | A | 7/1996 | Kinnunen et al. | |
| 5,673,870 | A | 10/1997 | Fielding et al. | |
| 5,690,298 | A | 11/1997 | Ruck | |
| 5,735,481 | A * | 4/1998 | Loosen | 242/526.1 |
| 5,816,528 | A * | 10/1998 | Ekstrom et al. | 242/541.5 |
| 5,848,756 | A | 12/1998 | Sollinger et al. | |
| 5,875,990 | A * | 3/1999 | Svanqvist et al. | 242/542.3 |
| 5,918,830 | A | 7/1999 | Verajankorva et al. | |
| 6,047,917 | A * | 4/2000 | Ekstrom et al. | 242/541.3 |
| 6,402,081 | B1 | 6/2002 | Rautakorpi et al. | |
| 6,402,082 | B1 | 6/2002 | Madrzak et al. | |
| 6,443,387 | B1 * | 9/2002 | Mercer et al. | 242/532.3 |
| 6,474,589 | B1 | 11/2002 | Enwald et al. | |
| 6,581,868 | B1 | 6/2003 | Enwald et al. | |
| 6,595,456 | B2 * | 7/2003 | Rummage | 242/476.6 |
| 6,595,459 | B2 * | 7/2003 | Hanson | 242/532.3 |
| 6,629,659 | B1 | 10/2003 | Innala et al. | |
| 6,695,245 | B1 * | 2/2004 | Schultz et al. | 242/532.2 |
| 6,739,544 | B2 | 5/2004 | Yuuki et al. | |
| 6,779,751 | B2 * | 8/2004 | Rummage | 242/476.6 |
| 6,926,222 | B2 * | 8/2005 | Rummage | 242/476.6 |

FOREIGN PATENT DOCUMENTS

| | | |
|---|---|---|
| EP | 1 245 515 A1 | 10/2002 |
| GB | 2 061 873 | 5/1981 |
| GB | 2 077 699 | 12/1981 |
| WO | WO 99/19241 | 4/1999 |
| WO | WO 11/47502 | 8/2000 |

* cited by examiner

*Primary Examiner*—Sang Kim
(74) *Attorney, Agent, or Firm*—McGlew and Tuttle, P.C.

(57) ABSTRACT

The rod (A) for winding reels of weblike material includes a cylindrical surface for winding of the weblike material, on which members (P) for engagement of an initial portion of the weblike material to be wound.

9 Claims, 10 Drawing Sheets

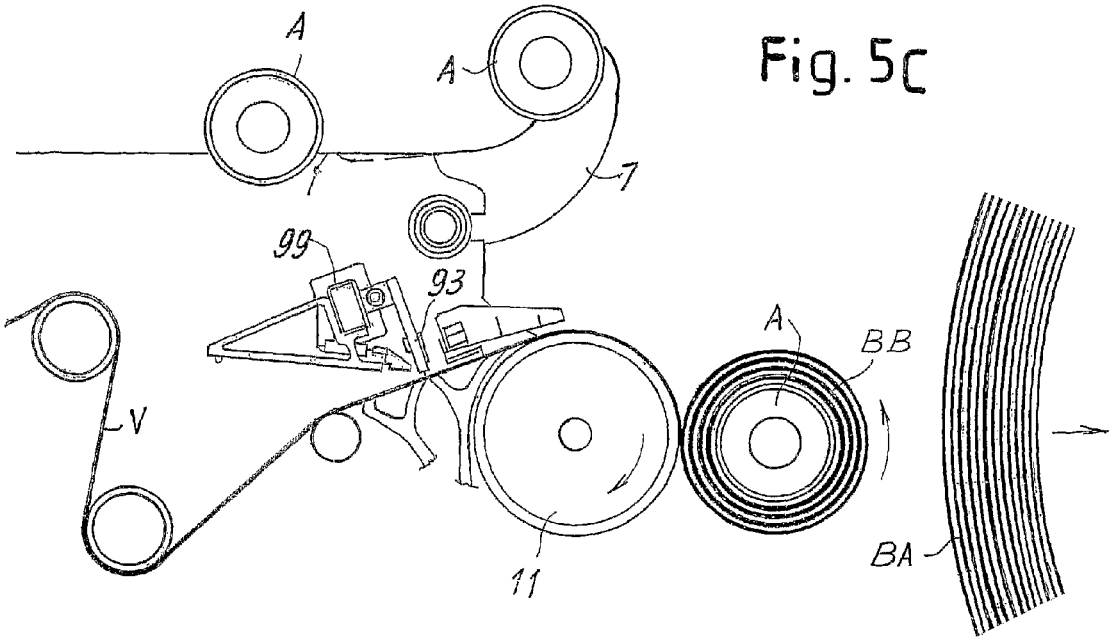
Fig. 5C
Fig. 6
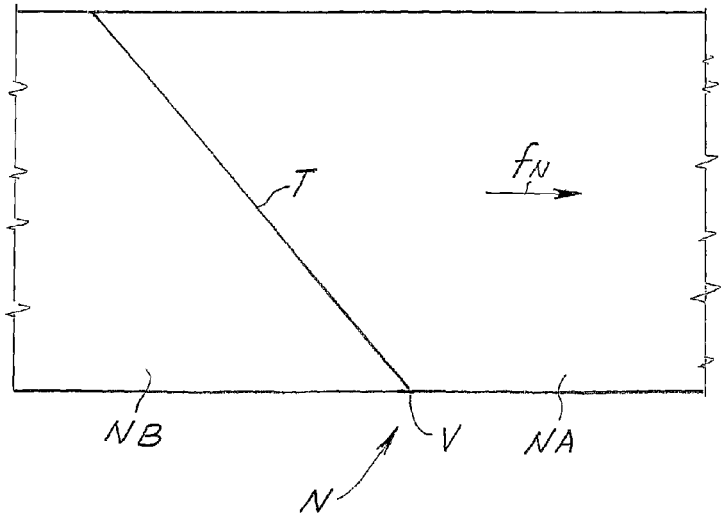

WINDING ROD FOR WINDING REELS OF WEBLIKE MATERIAL, AND MACHINE THAT USES SAID ROD

TECHNICAL FIELD

The present invention relates to improvements made to the winding rods used in the so-called reeling machines or reelers for the production of rolls or reels of wound weblike material, typically but not exclusively non-woven fabric.

STATE OF THE ART

In several industrial fields, endless weblike materials are produced and handled and wound in rolls or reels, which are then subjected to subsequent processes. A weblike material that is frequently wound in reels, which are to undergo subsequent processes of transformation into semi-finished and finished products is non-woven fabric, which is used in many fields, in particular but not exclusively, in the field of production of hygienic and sanitary articles, such as nappies for babies, sanitary pads for incontinency, pantie liners for women, and similar products, or in the field of production of napkins, tablecloths, sheets, or also garments of clothing and other products, as well as in the field of production of filters, and other technical articles.

The reels wound on winding rods are frequently unwound and rewound in rolls of smaller axial and/or diametral dimensions, and then undergo further transformation to obtain the finished articles.

Typically, set downstream of the machine for the production of weblike material is a reeling machine, also referred to as "reeler", in which the weblike material is run over a winding member, typically a winding roller, against which the reel is pressed in the step of formation around a winding rod or shaft. The reel is kept in rotation as a result of the tangential force applied peripherally thereon by the winding roller. The rod on which the reel is formed rests on rolling guides and is held against the winding roller via adequate supports. Once the reel has been completed, the weblike material is interrupted, and a new winding rod is inserted up against the winding roller.

An example of the reeling machine or reeler of the above type is described in EP-A-1245515. Other machines of the same type are described for example in WO-A-0047502, U.S. Pat. No. 6,629,659, U.S. Pat. No. 5,918,830, U.S. Pat. No. 5,531,396, U.S. Pat. No. 5,393,008, U.S. Pat. No. 4,283,023, U.S. Pat. No. 4,143,828, U.S. Pat. No. 5,848,756, U.S. Pat. No. 5,690,298, U.S. Pat. No. 5,251,835, U.S. Pat. No. 3,471,097, U.S. Pat. No. 6,402,082, U.S. Pat. No. 6,402,081, U.S. Pat. No. 6,739,544, U.S. Pat. No. 6,581,868, U.S. Pat. No. 6,474,589, U.S. Pat. No. 4,196,865, and U.S. Pat. No. 5,673,870.

Usually the above machines have a pair of supports that engage the ends of the winding rod in order to exert pressure upon the reel being formed, to press it against the winding roller. The gradual growth of the diameter of the reel causes recession of the supports from the winding roller. Once winding is completed, the reel is released, and the supports again translate into a position adjacent to the winding roller, to receive a new rod that is introduced by an inserting member that picks it up from a magazine normally overlying the winding roller.

This operation involves some drawbacks that are reflected principally in a non-adequate tensioning of the last coils of the reel formed, and in a non-adequate tensioning of the first coils of the new reel. This is due to the lack of adequate control of the exchange phase, in which the pair of supports is disengaged from the completed reel and proceeds to engaging the new rod.

OBJECTS AND SUMMARY OF THE INVENTION

An object of the present invention is to provide a new type of winding rod that will render more efficient the step of transfer of the leading end of the weblike material onto the winding rod or shaft in the initial step of winding of each reel in the machines of the type mentioned above.

Basically, according to a first aspect, the invention regards a rod for winding reels of weblike material, with a cylindrical surface of winding of said weblike material, said rod being characterized in that it comprises, on at least one portion of its own cylindrical surface, members for engagement of an initial portion of the weblike material to be wound.

The above members for engagement are preferably members for mechanical engagement, comprising projections, in the form of needles, stems, hooks, or the like, which grip the weblike material to start winding thereof.

The elements or members for engagement can be made of plastic material of adequate hardness, or else of metal, and project preferably in a radial or approximately radial direction from the cylindrical surface of the rod.

In an advantageous embodiment, the elements are distributed along annular areas, preferably arranged adjacent to the ends of the rod, whilst the central area of the cylindrical surface of the rod can be without said elements for engagement of the weblike material.

In an advantageous embodiment, the rod has, at each end, a respective shank for resting on supporting guides of a reeling machine.

The invention also regards a reeling machine including: a path for a weblike material; a winding member, around which the weblike material is fed; a pair of supporting guides for winding rods, extending from said winding roller; and at least one rod as described above.

Further advantageous features and embodiments of the invention are described in what follows, with reference to a non-limiting example of embodiment.

BRIEF DESCRIPTION OF THE DRAWINGS

For a better understanding of the invention, there now follows a description thereof with reference to the attached drawing, which shows a practical non-limiting embodiment of the invention. More in particular, in the plate of drawings:

FIGS. 5A, 5B, 5C show a schematic operative sequence of the operating cycle; and FIG. 6 is a schematic representation of the form of the cutting line made on the weblike material.

DETAILED DESCRIPTION OF A PREFERRED EMBODIMENT OF THE INVENTION

Figure 1:
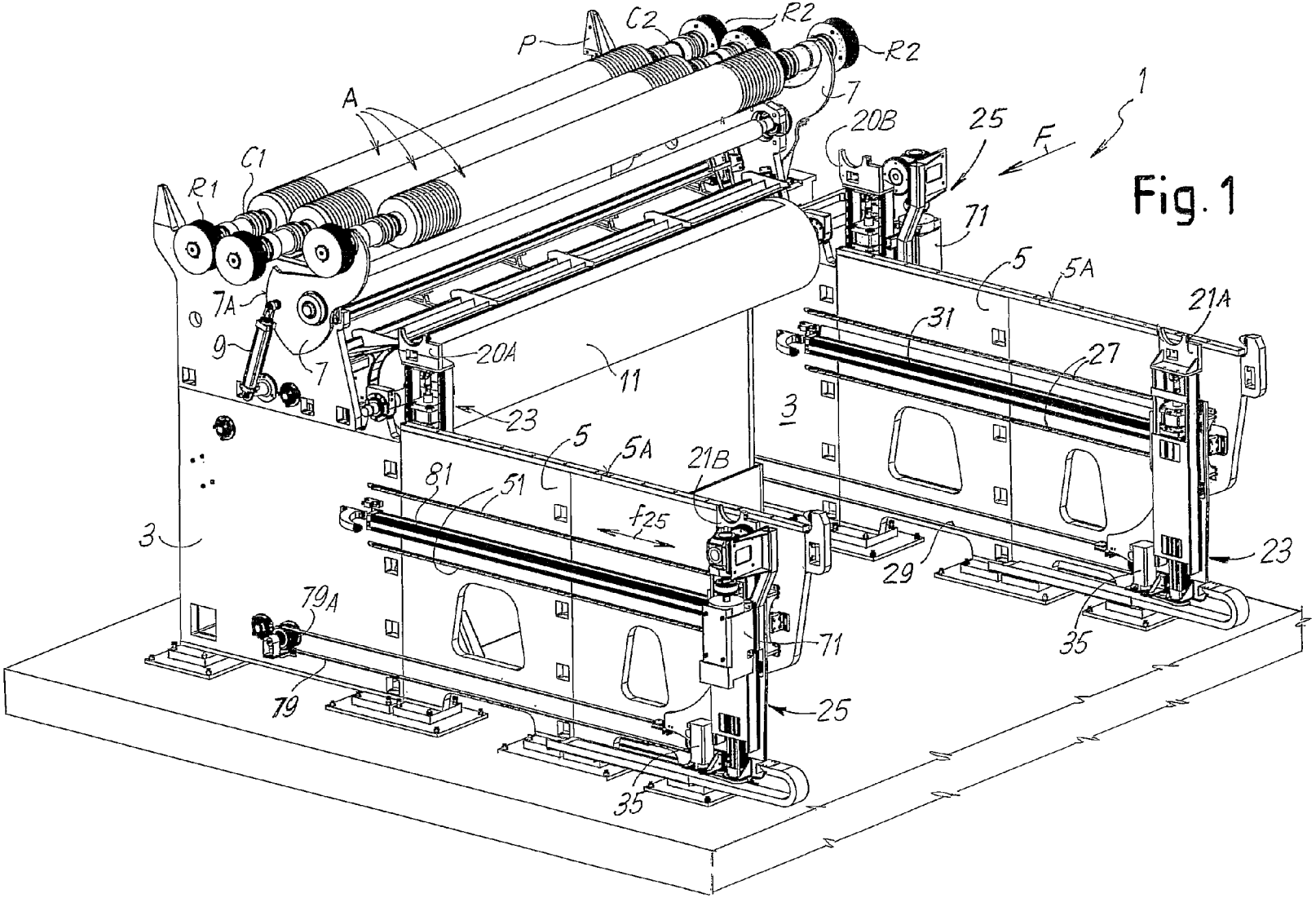
FIG. 1 is a perspective view of the machine in one embodiment.

FIG. 1 shows, as a whole, a machine which implements the invention, it being understood that the principles underlying the invention can be implemented and incorporated also in machines different from the one illustrated. The machine is designated as a whole by the reference number 1 and has a load-bearing structure 3 to which two mutually parallel sides 5 are fixed, which define, at the top, guides 5A for resting and rolling of winding rods A. These rods are arranged in a magazine defined in the top part of the machine and are inserted in sequence one after the other into a winding area, as described in what follows. For said purpose, a pair of oscillating arms 7 is provided, which are controlled by a cylinder-piston actuator 9. The arms 7 pick up the winding rods A one by one and deposit them on pairs of supports described in greater detail in what follows, associated to the sides 5. The arms 7 are shaped in such a way that a perimetral portion 7A thereof withholds the rods subsequent to the one that each time is picked up by the pair of arms 7, in order to start winding a new reel of weblike material around it.

Figure 1A:
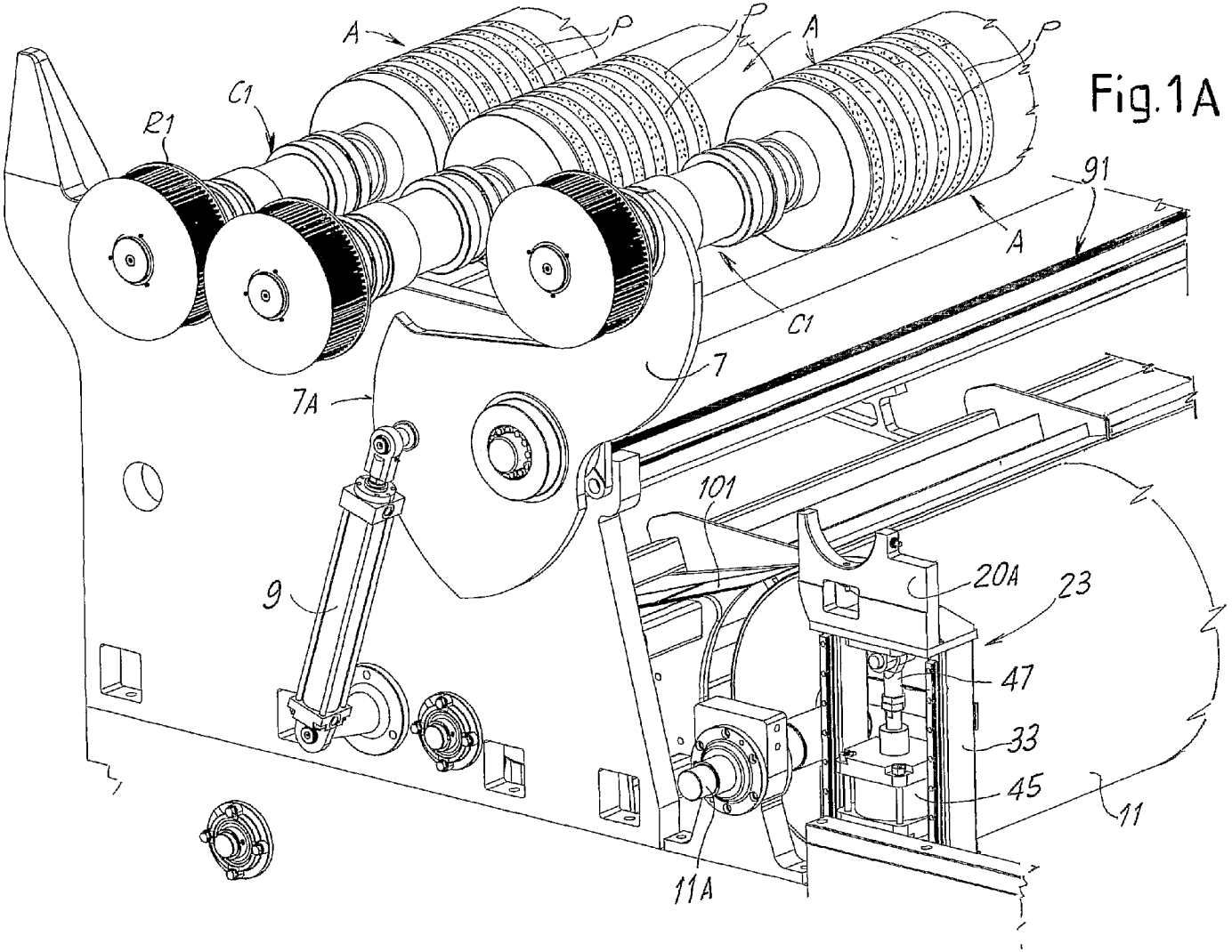
FIG. 1A is an enlarged detail of FIG. 1 in the area of introduction of the winding rods.

The machine has a winding member that, in a preferred embodiment, is formed by a winding roller 11 with an axis of rotation 11A (FIG. 1A) parallel to the axis of oscillation of the arms 7 and to the axis of the rods A.

Figures 2, 2A:
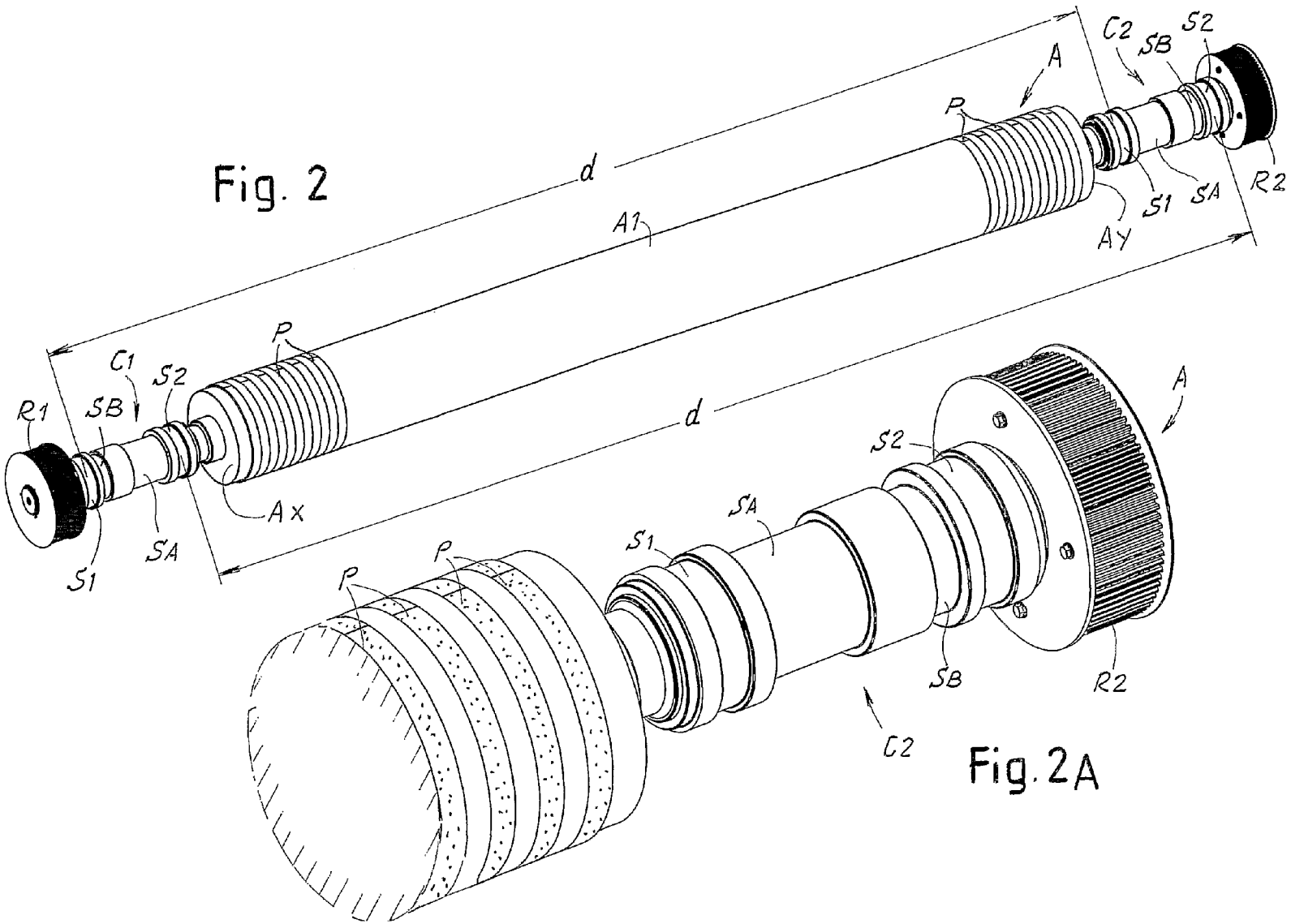
FIG. 2 is an axonometric view of a winding rod.
FIG. 2A is an enlarged detail of one end of the rod of FIG. 2.

The structure of each winding rod A is indicated in detail in FIGS. 2 and 2A. The rod has a body with a main cylindrical portion A1, at the ends of which shanks C1 and C2 are connected, which are coaxial to the main cylindrical portion A1. Adjacent to the ends AX and AY of the portion A1 of the rod are annular portions P equipped with a coating constituted preferably by asperities formed by pins or needles made of metal, plastics or other material of suitable strength and stiffness, which have (as will emerge more clearly from what follows) the purpose of engaging the initial portion of the leading edge of the weblike material and causing it to adhere to the cylindrical surface of the rod A to start winding of each reel.

Fitted on the two shanks C1 and C2 are gears R1 and R2, which have the function of meshing with gears with which the supports of the winding rods are equipped, as will be clarified later on, in order to impart a movement of rotation upon the rods A about their axis when these are supported by the supports 20A and 20B or 21A and 21B in the position of maximum height (already referred to as engagement height) awaiting rod change (FIG. 5A) in order to bestow on said rods the same peripheral velocity as that of the winding roller 11. In addition, the two gears R1 and R2 have also the function of meshing with the aforesaid gears with which the supports of the winding rods are equipped, in order to bestow a movement of rotation upon the rods A about their axis even when the reels formed thereon are no longer in contact with the winding roller or other winding member 11.

Each shank C1, C2 moreover forms an element for resting on the guides 5A, which are formed by the sides 5, and has a conformation such as to engage the respective guide 5A, preventing the rod from translating parallel to its own axis during rolling along the guides 5A. In addition each shank C1, C2 is shaped for co-operating with the arms 7 and with the supports of the machine.

More in particular, the shanks C1, C2 have a first annular seat S1 and a second annular seat S2 for co-operating with the supports of the machine. As will emerge more clearly from what follows, each rod will be engaged by a pair of supports in a position corresponding to the two seats S1, or else to the two seats S2. The seats S1, S2 are arranged on the two shanks C1, C2 in such a way that the two annular seats S1 have the same distance from one another as the seats S2, said distance being designated by d in FIG. 2. Between the annular seats S1, S2 each shank C1, C2 has an annular groove SA that is designed to co-operate with the respective resting and rolling guide 5A of the respective side 5. Between the annular groove SA and the outermost of the annular seats S1, S2 each shank C1, C2 has a further annular groove SB for engagement by the two oscillating arms 7.

In FIG. 1, the references 20A, 20B and 21A, 21B designate four supports for the winding rods, arranged in pairs, the supports 20A, 20B forming a first pair of supports for a first rod, and the supports 21A, 21B forming a second pair of supports for a second winding rod A.

Figure 1B:
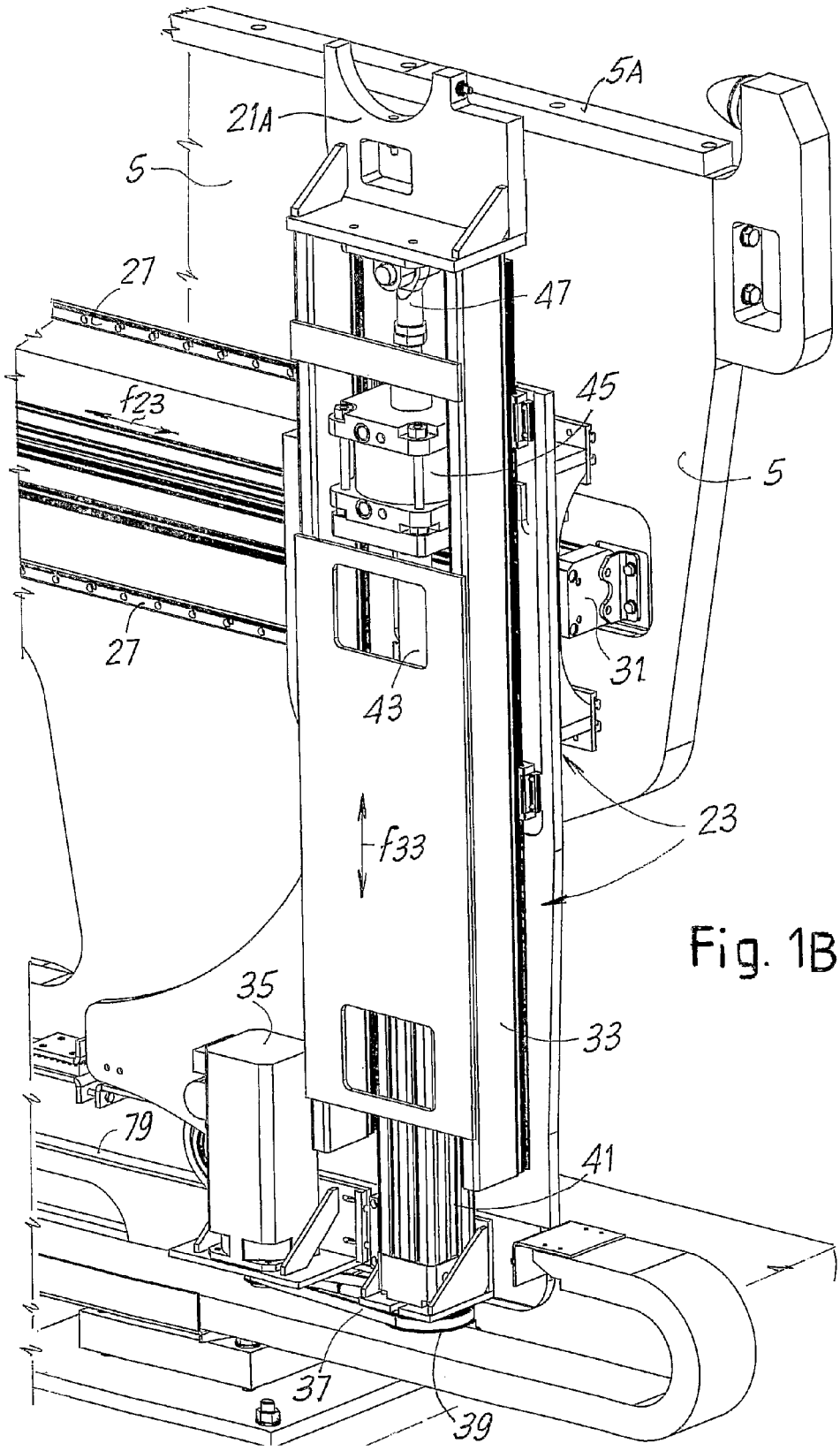
FIG. 1B is an enlarged detail of FIG. 1 in the area of one of the supports of the winding rods.

The supports 20A and 21A are arranged within the respective sides 5, whilst the supports 20B and 21B are arranged on the outside of the respective sides. Each of the supports 20A, 20B is set on a respective carriage 23, said carriages being substantially symmetrical and only one of them will be described in greater detail in what follows with reference to FIG. 1B.

Figure 1C:
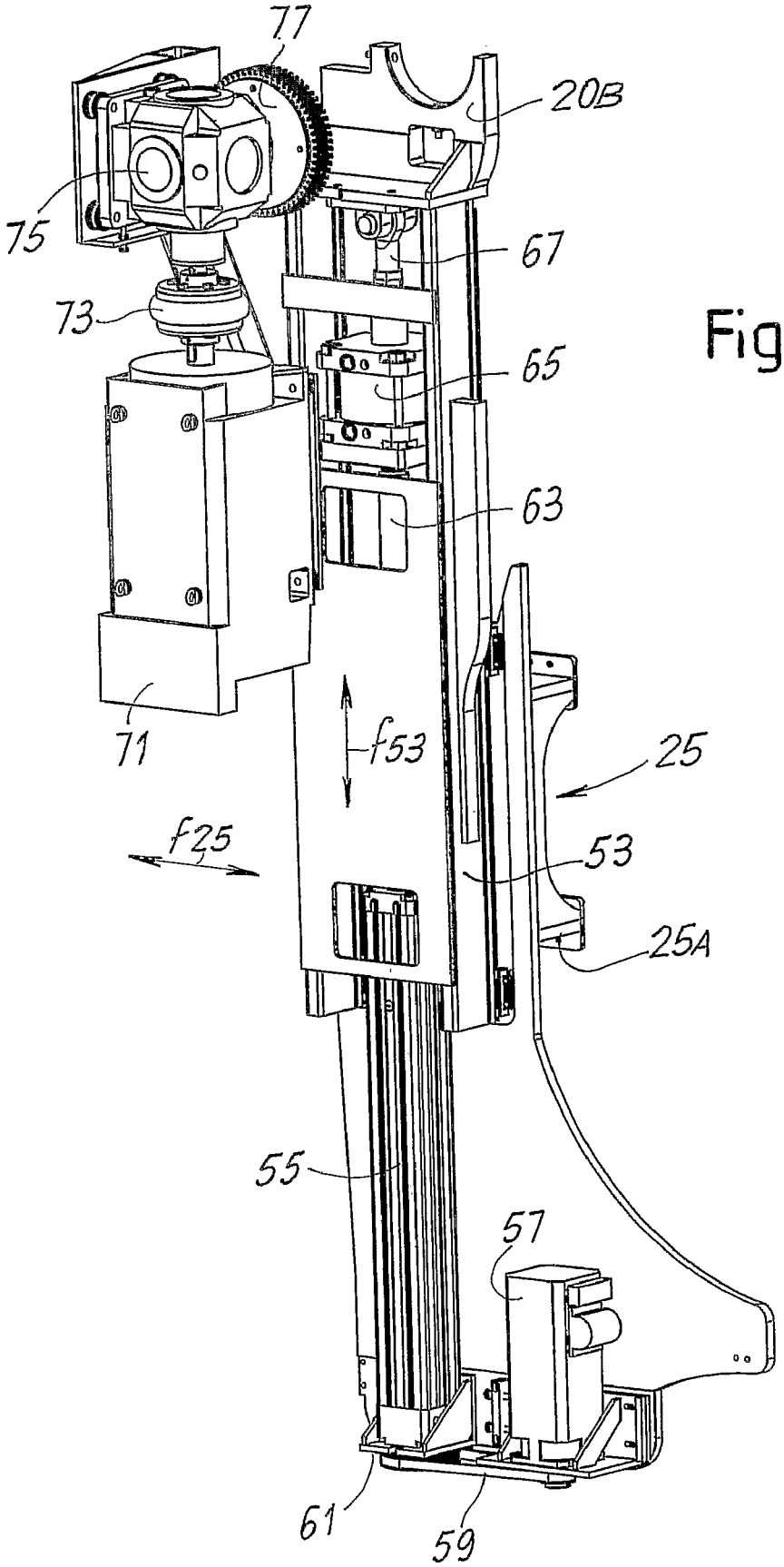
FIG. 1C is an enlarged detail of another of the supports of the winding rods.

The supports 20B and 21B are arranged, instead, on carriages 25, which also are substantially symmetrical and only one of them will be described with reference to FIG. 1C. This figure in particular illustrates in isolation and in a partially exploded view the carriage 25 on which the support 20B is mounted. The carriage represented in FIG. 1C is viewed from the side opposite to the one visible in FIG. 1; i.e., it is viewed in the direction of the arrow F.

Each carriage 23 (FIG. 1B) is able to slide along guides 27 fixed to the respective side 5. Said guides 27 are arranged on the internal face of the two sides 5. The carriage 23 is mobile along the guides 27 in the direction of the double-headed arrow f23. The movement is controlled alternately by two different mechanisms. The movement from the position furthest away from the winding roller 11 to the position of the roller itself (namely, the position in which the carriage 23 that holds the support 21A is located, in the view of FIG. 1) is driven by a belt 29, to which the carriage is constrained, by means of an actuator (not illustrated), which drives one of the pulleys over which the belt 29 is run. The movement in the opposite direction, i.e., in the direction of recession away from the winding roller 11, is obtained as a result of the gradual growth of a reel around the winding rod that is temporarily engaged to the respective support 20A or 21A and in contact with the winding roller 11. The reference number 31 designates a cylinder-rodless piston actuator, which pushes the carriage 23 towards the roller 11 in such a way that the reel, in the step of formation around the rod held by the support 21A or 21B, is pressed against the winding roller 11 to enable the latter to carry out winding, transmitting the motion of rotation to the reel.

Set on the carriage 23 is a slide 33, which is vertically mobile in the direction of the double-headed arrow f33. The vertical movement according to f33 is controlled by a servo motor 35 through a belt 37, which transmits the motion to a pulley 39 of a linear actuator 41, which has a bar 43 that can be extracted and retracted to cause the displacements according to f33 of the slide 33. Constrained to the rod 43 is a cylinder-piston actuator 45, of which designated by the reference number 47 is the rod hinged to the support 21A or 21B.

With the arrangement of the linear actuator 41 and of the cylinder-piston actuator 45, a system is obtained that can impose upon the support 21A or 21B a vertical movement constituted by an extended stroke controlled by the linear actuator 41 at a relatively slow speed and a supplementary short stroke controlled by the cylinder-piston actuator 45 at a relatively high speed. This double movement enables an effective grip of the winding rods and their effective gradual introduction into the area of winding after they have duly been brought into contact with the winding roller 11 to receive the leading end of the weblike material each time generated by cutting thereof, as will be described in greater detail in what follows with reference to an operating sequence.

The configuration of the carriage 25 that carries one or the other of the supports 20B, 21B is substantially equivalent to that of the carriage 23, as may be noted in the representation of FIG. 1C, where one of the carriages 25 is illustrated in isolation with respect to the side 5 that supports it. The reference 25A designates the slides that guide the carriage 25 on guides 51 fixed to the respective side 5 and equivalent to the guides 27. Set on the carriage 25 is a slide 53, which is vertically mobile in the direction indicated by the arrow f53, the movement of which is controlled by a linear actuator 55 driven by a servo motor 57 by means of a belt 59 and a pulley 61. The reference number 63 designates the extractable and retractable bar of the linear actuator 55, which is constrained at the top by a cylinder-piston actuator 65 equivalent to the cylinder-piston actuator 45 of the carriage 23. The rod 67 of the cylinder-piston actuator 65 is constrained to the support 20B or else 20A. Up to this point the structure of the carriage 25 is substantially the same as that of the carriage 23.

Unlike the carriage 23, on the carriage 25 there is further set an electric motor 71, at the output of which, by means of a joint 73, there is connected a reduction gear 75 (FIG. 1C). This arrangement supplies motion to a respective gear 77 that is to mesh with the corresponding gear R1 or else R2 of the rod that is temporarily supported by one or by the other of the supports 20A, 20B. The motor 71 thus provides the movement of rotation for the auxiliary operations on the winding rod A when this is not driven in rotation by the winding roller 11.

The horizontal movement in the direction indicated by the double-headed arrow f25 is exerted upon the carriage 25 in a way similar to what has been described with reference to the carriage 23. A belt 79 run over a motor-driven pulley 79A controls the movement of approach to the winding roller 11, whilst the movement of gradual recession during winding is caused by the thrust between the reel being formed around the rod A resting on the supports 20A, 20B or else 21A, 21B and the roller 11, said thrust being ensured, not only by the cylinder-rodless piston actuator 31, but also by the cylinder-rodless piston actuator 81 associated to each of the carriages 25 and arranged on the outside of the sides 5.

Figure 3:
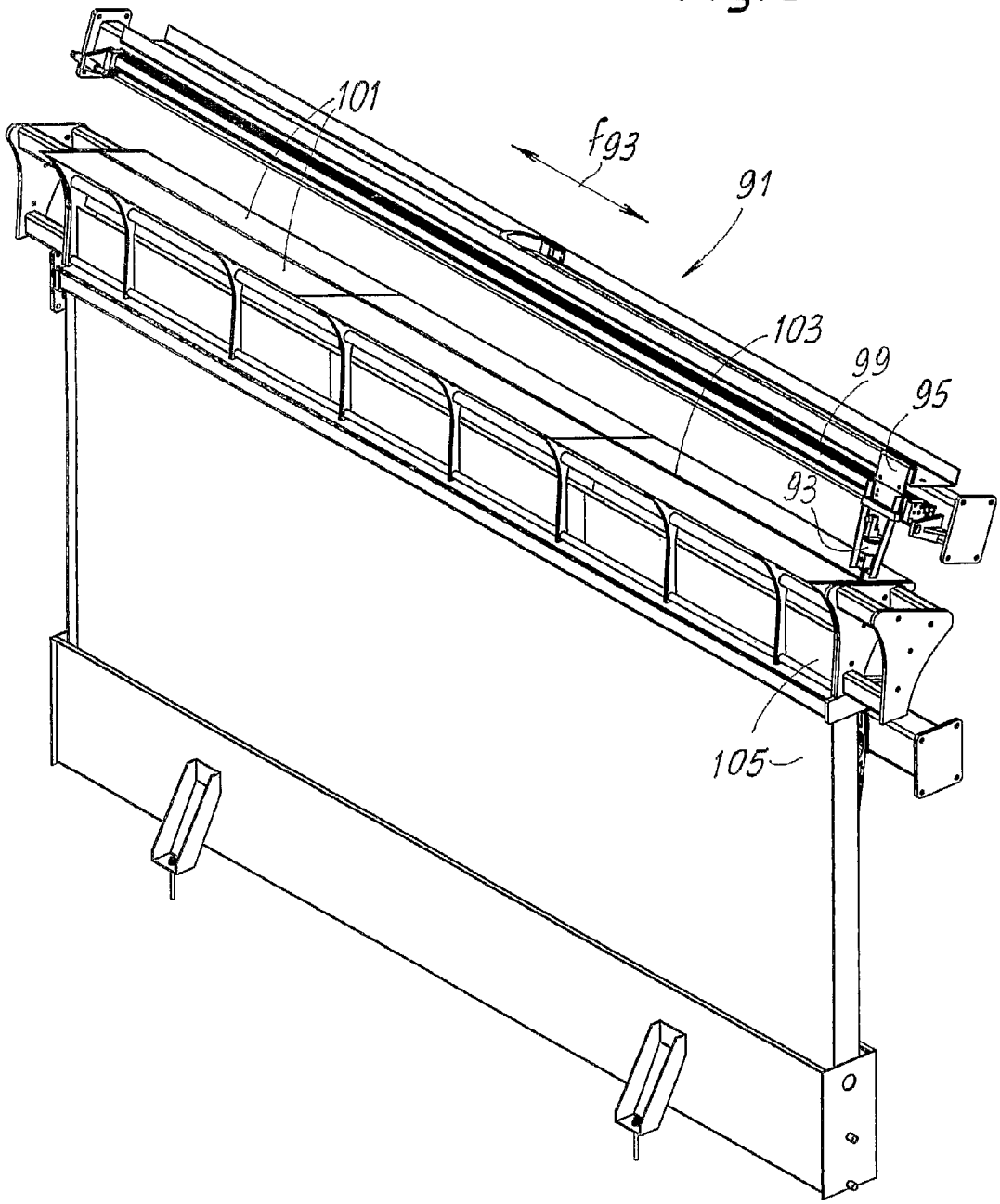
FIG. 3 is an axonometric representation of the cutting device isolated from the remaining parts of the machine.
Figure 3A:
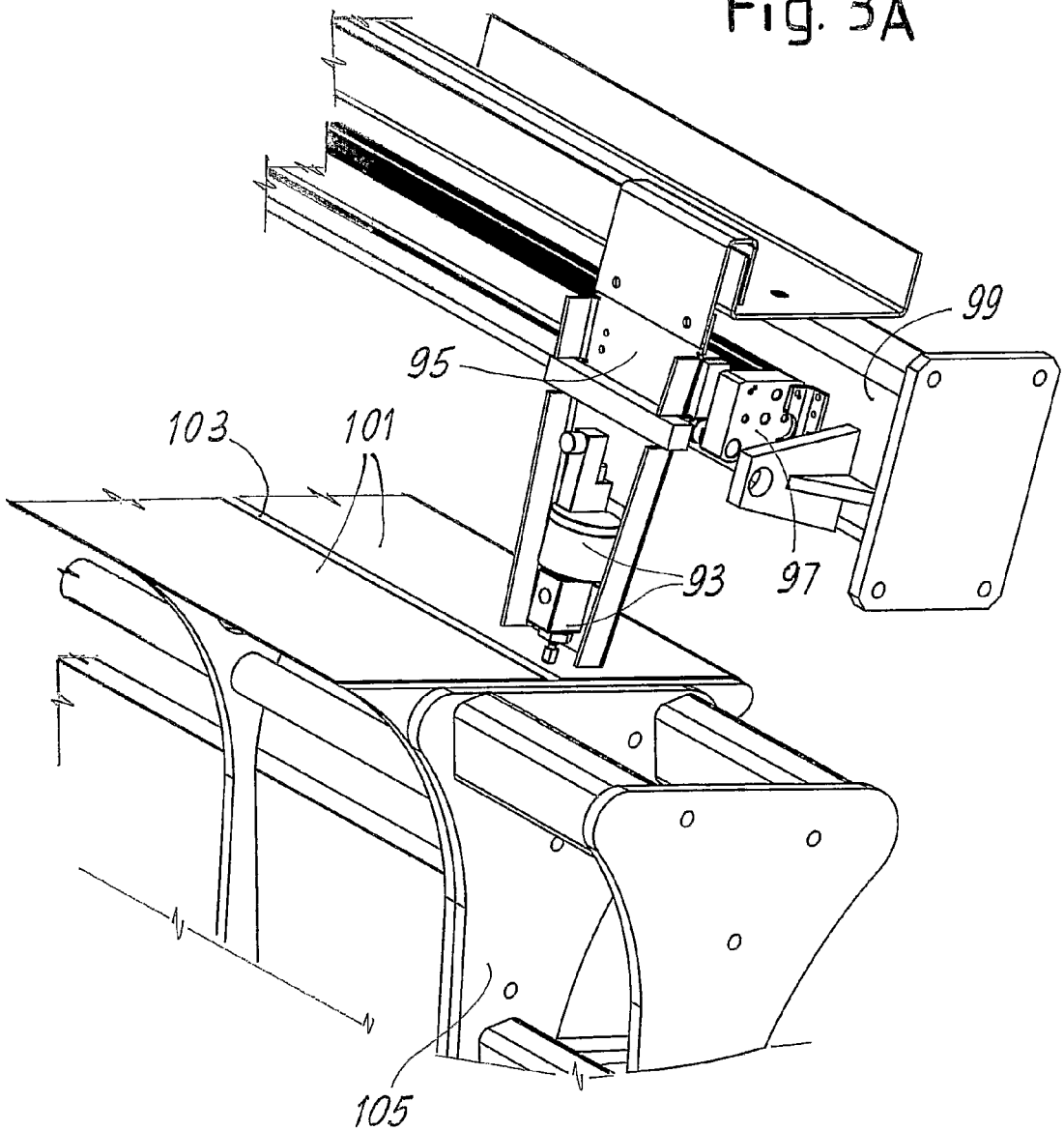
FIG. 3A is an enlarged detail of FIG. 3.
Figure 4:
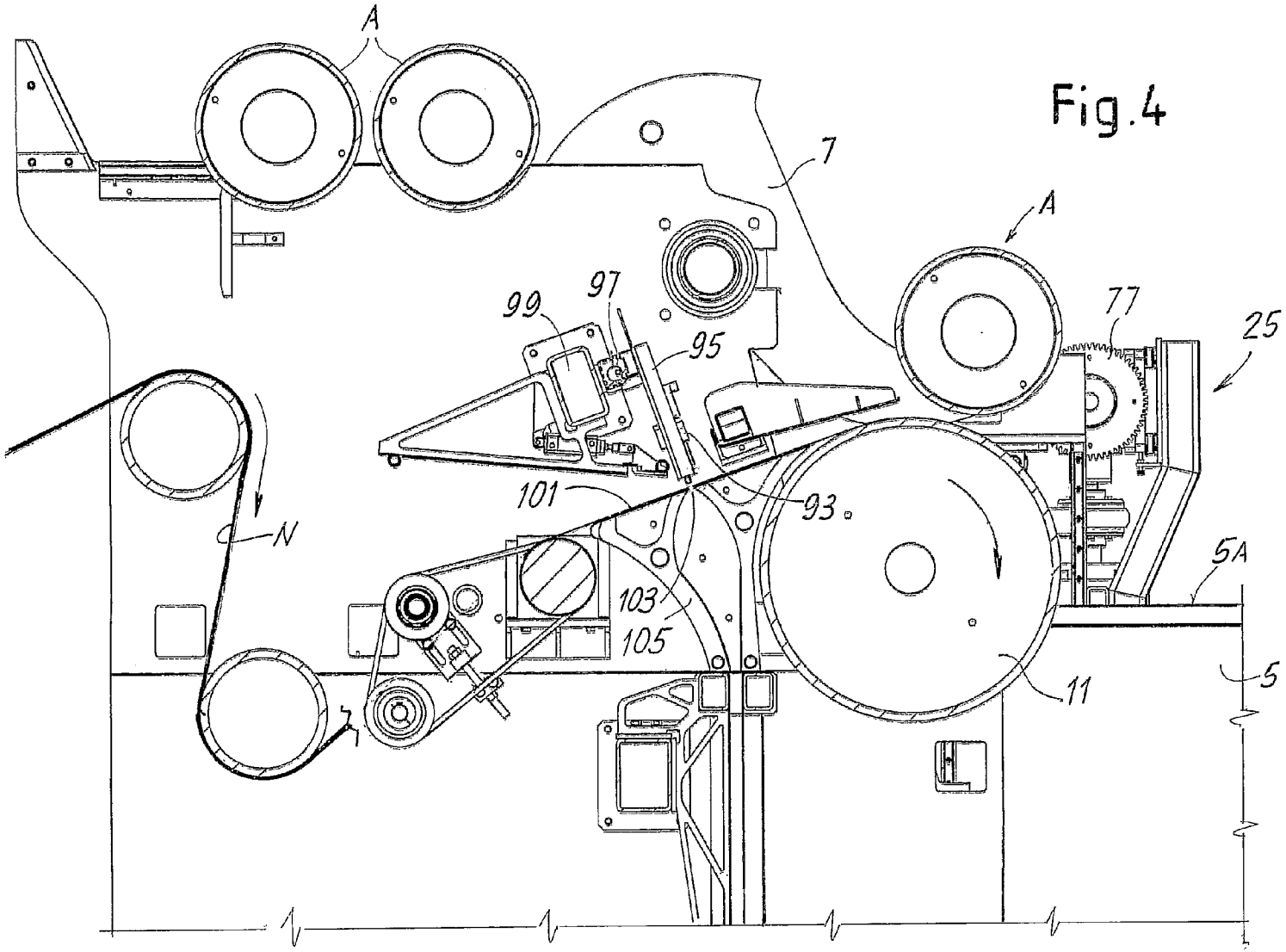
FIG. 4 is a median section along a vertical plane of the area for winding, cutting of the weblike material, and introduction of the winding cores.

As may be noted in particular in FIG. 4, located along the path of the weblike material N, upstream of the winding roller 11 is a cutting device designated as a whole by 91 and illustrated in isolation in FIG. 3 and in the enlarged detail of FIG. 3A. The cutting device 91 comprises a pressurized-water nozzle 93 carried by a slide 95 having a reciprocating rectilinear movement in the direction indicated by f93, orthogonal to the direction of feed of the weblike material N along the path of advance through the machine. The movement of the slide 95 and of the nozzle 93 carried thereby is controlled by a cylinder-rodless piston actuator 97 supported by a beam 99.

Located underneath the path of the nozzle 93, and on the side opposite thereto with respect to the path of the weblike material, is a sliding surface 101, along which the weblike material runs, said surface being interrupted by a groove 103, which is parallel to the path of the nozzle 93 and is located exactly underneath the latter. Developing underneath this groove 103 are tanks 105 for collecting the water, which comes from the nozzle 93 and is ejected at a high pressure therefrom. In the tanks there may be arranged systems for extinguishing the kinetic energy of the jet of water.

The machine described so far operates according to the cycle illustrated hereinafter with reference to the sequence of FIGS. 5A-5C.

Figure 5A:
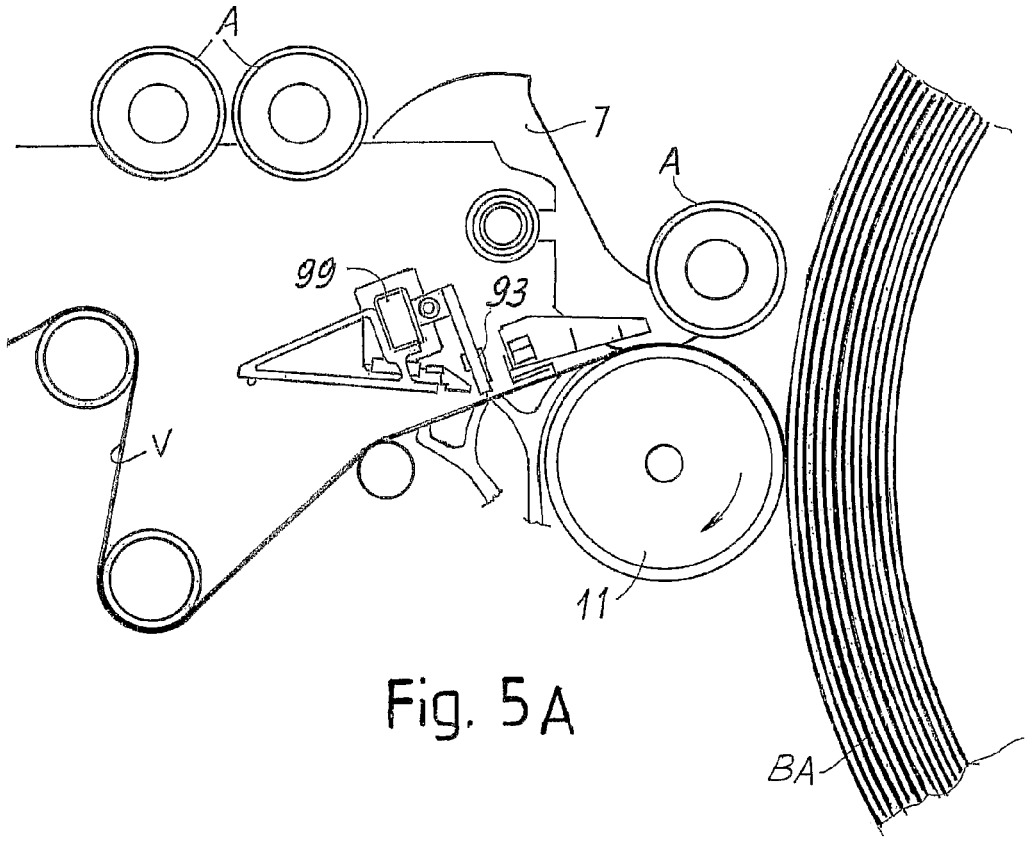

FIG. 5A illustrates a step in which a reel BA of weblike material N is being formed on a first winding rod A. The winding rod is supported by the first pair of supports 20A, 20B. The cylinder-rodless piston actuators 31, 81 push the carriages 23, 25 and hence the reel BA against the winding roller 11 so that rotation of the latter causes feed of the weblike material and rotation of the reel BA and of its winding rod and consequently winding of the material around the rod.

With the gradual increase in the diameter of the reel BA, the supports 20A, 20B are displaced towards a position for unloading, which is located at the opposite ends of the guides 5A with respect to the position in which the winding roller 11 is located. In this step the weight of the rod and of the reel is for the most part supported by the rolling guides 5A.

Figure 5B:
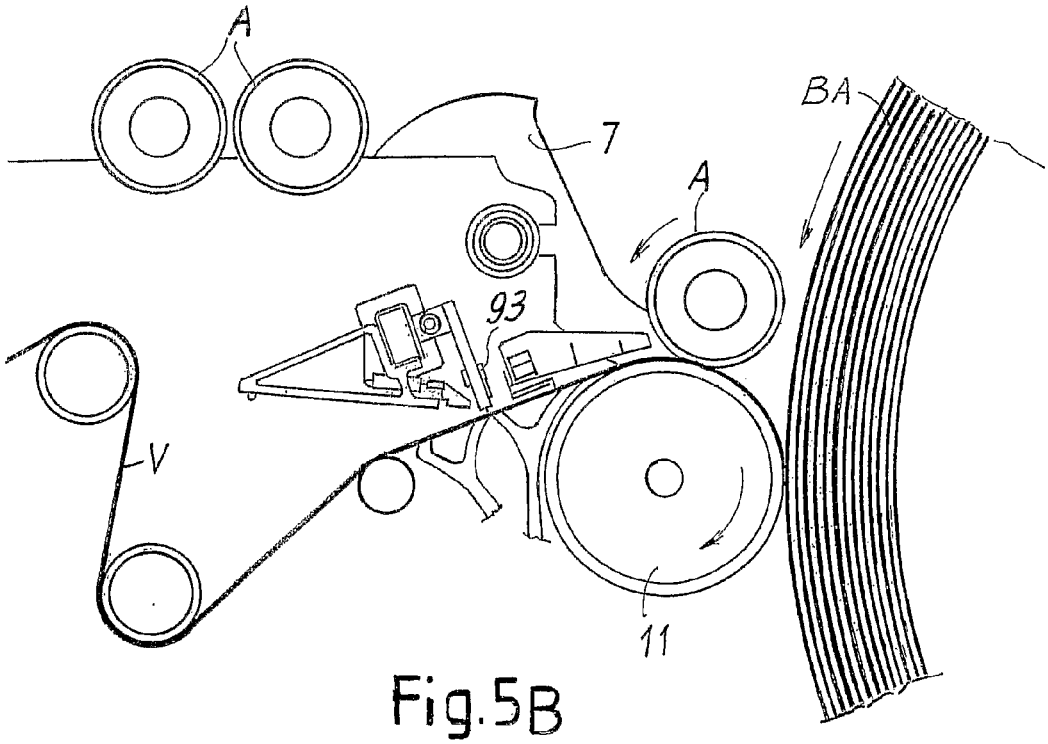

FIG. 5B illustrates a further step, in which the reel BA being formed carried by the supports 20A, 20B is by now close to completion and hence very close to the area of unloading. The supports 21A, 21B of the second pair of supports have been brought, via translation of the corresponding carriages 23, 25 driven by the belts 29, 79, into a position adjacent to the winding roller 11. In this step a new winding rod is unloaded by the oscillating arms 7 onto the pair of supports 21A, 21B, which for this purpose have been raised to an appropriate height.

When the reel BA has been completed and the weblike material is to be cut to give rise to winding of a new reel BB, the water nozzle 93 is activated and starts projecting a jet of water at high pressure. The nozzle 93 is made to translate in a direction transverse to the direction of feed of the weblike material along the path of feed with a rate such as to cause formation of an initial or leading free end and of a final or trailing end in the weblike material N with an adequate shape (see FIG. 6) where the letter T designates the cutting line, NA the trailing end of the portion of weblike material wound onto the reel BA, and NB the leading end of the weblike material which will be wound onto the next rod to form the reel BB.

The inclination of the cutting line T with respect to the direction of the machine, represented by the direction of feed fN of the weblike material, is such that the most advanced vertex V defined in the leading end NB comes into contact with the new rod, which has duly been lowered towards the winding roller 11 via retraction of the cylinder-piston actuators 45, 65, before the cutting T is completed. This guarantees that winding on the rod BA will terminate with the weblike material always in tension and that the weblike material will start to be wound in a correct way and still in tension onto the new rod A to form the next reel BB.

Via actuation of the linear actuators 55, 41 the supports 21A, 21B are then gradually lowered, so as to keep the rod A (onto which the product is being wound) always in contact with the winding roller 11, whilst the reel BB starts to grow in diameter until the shanks of the new winding rod rest on the resting and rolling guides 5A. At the end of winding, the supports 21A, 21B will then be further lowered in order to free the rod with the reel wound thereon, thus enabling it to be unloaded and allowing the supports to translate once again towards the area in which the winding roller is located.

Since the pair of supports 21A, 21B and the pair of supports 20A, 20B are staggered with respect to one another in a direction parallel to the axis of the winding rod, to enable mutual exchange of position of the two pairs of supports, the shanks C1, C2 of the rods each have two distinct annular seats S1, S2 for co-operating with the supports 21A, 21B and 20A, 20B, respectively.

It is understood that the drawing only shows one example, provided purely by way of practical implementation of the invention, it being possible for the invention to vary in the embodiments and arrangements, without thereby departing from the scope of the idea underlying the invention.

The invention claimed is:

1. A reeling machine comprising:

a path for a weblike material;

a winding roller around which the weblike material is fed;

a pair of supporting guides for winding rods, each supporting guide extending from said winding roller; and a rod comprising a main body with a cylindrical surface for winding of the weblike material, shanks connected to said main body and members on at least one portion of said cylindrical surface for engaging an initial portion of the weblike material to be wound, said members being arranged at least in an area of two opposite ends of the rod, said members including projections, said projections gripping the weblike material such that the weblike material adheres to the cylindrical surface of the rod, said rod being supported rotatably and linearly movable on said guides by means of said shanks.

2. The reeling machine according to claim 1, wherein said members comprise thin and pointed elements projecting from the cylindrical surface of the rod.

3. The reeling machine according to claim 2, wherein said elements are made of plastic or metal material.

4. The reeling machine according to claim 3, wherein said elements project radially from said cylindrical surface.

5. The reeling machine according to claim 2, wherein said elements project radially from said cylindrical surface.

6. The reeling machine according to claim 1, further comprising an intermediate portion having a cylindrical surface without said members for engagement.

7. The reeling machine according to claim 1, further comprising a gear at at least one of the ends.

8. The reeling machine according to claim 1, further comprising a severing device for severing said weblike material, arranged along the path of the weblike material upstream of said winding member.

9. The reeling machine in accordance with claim 1, wherein:

said members are distributed along circumferential annular areas of said cylindrical surface

* * * * *